US010930235B2

(12) United States Patent
Kang

(10) Patent No.: US 10,930,235 B2
(45) Date of Patent: Feb. 23, 2021

(54) DRIVING METHOD AND DEVICE OF DISPLAY PANEL, AND DISPLAY DEVICE

(71) Applicants: Chongqing HKC Optoelectronics Technology Co., Ltd., Chongqing (CN); HKC Corporation Limited, Guangdong (CN)

(72) Inventor: Chihtsung Kang, Chongqing (CN)

(73) Assignees: Chongqing HKC Optoelectronics Technology Co., Ltd., Chongqing (CN); HKC Corporation Limited, Shenzhen (CN)

( * ) Notice: Subject to any disclaimer, the term of this patent is extended or adjusted under 35 U.S.C. 154(b) by 142 days.

(21) Appl. No.: 16/241,038

(22) Filed: Jan. 7, 2019

(65) Prior Publication Data

US 2020/0090605 A1 Mar. 19, 2020

Related U.S. Application Data

(63) Continuation of application No. PCT/CN2018/111334, filed on Oct. 23, 2018.

(30) Foreign Application Priority Data

Sep. 13, 2018 (CN) ..... 201811071066.4

(51) Int. Cl.
*G09G 3/36* (2006.01)

(52) U.S. Cl.
CPC ..... *G09G 3/3614* (2013.01); *G09G 3/3607* (2013.01); *G09G 3/3674* (2013.01); *G09G 3/3685* (2013.01); *G09G 2300/0452* (2013.01)

(58) Field of Classification Search
CPC .. G09G 3/3614; G09G 3/3674; G09G 3/3685; G09G 3/3607; G09G 2300/0452
See application file for complete search history.

(56) References Cited

U.S. PATENT DOCUMENTS

| | | | | |
|---|---|---|---|---|
| 2016/0293125 | A1* | 10/2016 | Huang | G09G 3/3614 |
| 2017/0263170 | A1* | 9/2017 | Mu | G09G 3/3614 |
| 2018/0059465 | A1* | 3/2018 | Koudo | G09G 3/3648 |

FOREIGN PATENT DOCUMENTS

| | | | |
|---|---|---|---|
| CN | 101317212 | A | 12/2008 |
| CN | 106991983 | A | 7/2017 |
| CN | 107820581 | A | 3/2018 |
| CN | 107833562 | A | 3/2018 |
| CN | 107886923 | A | 4/2018 |
| CN | 108091310 | A | 5/2018 |
| CN | 108107634 | A | 6/2018 |
| EP | 3012827 | A1 | 4/2016 |
| JP | 2007286216 | A | 11/2007 |
| WO | 2016171096 | A1 | 10/2016 |

* cited by examiner

*Primary Examiner* — Alexander Eisen
*Assistant Examiner* — Kebede T Teshome

(57) ABSTRACT

Disclosed a driving method and a device of display panel, as well as a display panel, taking a time duration of scanning at least three adjacent columns of pixel unit as a driving period, the common electrodes of even rows of sub-pixels and odd rows of sub-pixels in adjacent rows of pixel units are driven by a preset voltage in the current driving period, and when the first preset voltage and the second preset voltage meet preset conditions, the preset sub-pixels in the pixel units are driven according to a preset data driving signal input by a data driving circuit.

18 Claims, 6 Drawing Sheets

DRIVING METHOD AND DEVICE OF DISPLAY PANEL, AND DISPLAY DEVICE

CROSS REFERENCE TO RELATED APPLICATIONS

The present application is a Continuation Application of PCT Application No. PCT/CN2018/111334 filed on Oct. 23, 2018, which claims the benefit of Chinese Patent Application No. 201811071066.4 filed on Sep. 13, 2018. All the above are hereby incorporated by reference.

TECHNICAL FIELD

The present disclosure relates to the field of displays technology, and more particularly relates to a driving method and device of display panel, and a display device.

BACKGROUND

Large size liquid crystal display panels are mostly configured in vertical alignment (VA) type or in coplanar switching (IPS) type. Compared with IPS liquid crystal technology, VA type liquid crystal technology has the advantages of high production efficiency and low manufacturing cost, and also has the obvious defects in optical properties, such as color shift when large viewing angle images are presented.

When displaying an image, the brightness of a pixel should ideally change linearly with the voltage change, so that the driving voltage of the pixel can accurately represent the gray scale of the pixel and be reflected by the brightness. As shown in FIG. 1*a*, when VA type liquid crystal technology is used and the display screen is viewed from a smaller angle of view (e.g., front view), the brightness of the pixel can meet the ideal situation, i.e., it changes linearly with voltage, as shown by the ideal curve in FIG. 1*a*. However, when viewing the display screen at a larger viewing angle (e.g., 160 degrees or more to the display screen), due to the limitation of VA type liquid crystal technology, the brightness of the pixel appears to saturate rapidly with the voltage and then changes slowly, as shown in the actual curve in FIG. 1*a*. As a result, the gray scale that the driving voltage should have presented at a large viewing angle has seriously deviated, i.e. has a color shift.

The traditional way to improve color shift is to subdivide each sub-pixel into a main pixel and a subpixel, then the main pixel is driven with a relatively high driving voltage and the subpixel is driven with a relatively low driving voltage. One sub-pixel are displayed by the main pixel and the subpixel together. The relatively high driving voltage and the relatively low driving voltage can maintain a constant relationship between brightness and corresponding gray scale at the front viewing angle when driving the main pixel and the subpixel. Generally, in the first half of the gray scale, the main pixel is driven and displayed with a relatively high driving voltage and the subpixel does not display in the manner shown in FIG. 1*b*, and the brightness of the whole sub-pixel is half that of the main pixel. In the second half of the gray scale, the main pixel is driven and displayed with a relatively high driving voltage and the subpixel is driven and displayed with a relatively low driving voltage, and the brightness of the whole sub-pixel is half of the sum of the brightness of the main pixel and the brightness of the subpixel. After this synthesis, the luminance curve at a large viewing angle is the actual curve in FIG. 1*b*, which is closer to ideal curve, so that the color shift under a large viewing angle is improved.

However, the problem with the above method is that double the number of metal traces and driving devices are needed to drive the subpixels, so that the transparent opening area is sacrificed, the light transmittance of the panel is affected, and the cost is also higher.

SUMMARY

The present disclosure provides a driving method and a driving device of display panel, and a display device, as well as a storage medium based on data-based integrated drive circuit, which aims to improve large viewing angle color shift without increasing cost.

In order to achieve the above object, the present disclosure provides a driving method of display panel, the display panel includes a display array, the display array includes pixel units arranged in an array, the pixel unit includes a first sub-pixel, a second sub-pixel and a third sub-pixel in a first direction, and the three sub-pixels of the pixel unit are respectively aligned in a second direction according to an arrangement order; the method includes:

taking a time duration of scanning at least three adjacent columns of pixel unit as a driving period, driving a common electrode of a sub-pixel of the even rows in first column of the pixel unit and a sub-pixel of the odd rows in second column of the pixel unit with a first preset voltage in a current driving period, and driving a common electrode of a sub-pixel of the even rows in second column of the pixel unit and a sub-pixel of the odd rows in third column of the pixel unit with a second preset voltage in the current driving period; and driving a preset sub-pixel in the pixel unit according to a data driving signal input by a data driving circuit when the first preset voltage and the second preset voltage meet preset conditions, wherein the driving line where the first preset voltage and the second preset voltage are located is parallel to the data driving line input by the data driving circuit.

In addition, in order to achieve the above object, the present application also provides a driving device for display panel, the driving device includes a processor and a non-volatile memory, the non-volatile memory stores executable instructions, the processor executes the executable instructions, and the executable instructions includes:

a common electrode driving module, being configured to taking a time duration of scanning at least three adjacent columns of pixel unit as a driving period, driving a common electrode of a sub-pixel of the even rows in first column of the pixel unit and a sub-pixel of the odd rows in second column of the pixel unit with a first preset voltage in a current driving period, and driving a common electrode of a sub-pixel of the even rows in second column of the pixel unit and a sub-pixel of the odd rows in third column of the pixel unit with a second preset voltage in the current driving period; and a data driving module, being configured to drive a preset sub-pixel in the pixel unit according to a data driving signal input by a data driving circuit when the first preset voltage and the second preset voltage meet preset conditions, wherein the driving line where the first preset voltage and the second preset voltage are located is parallel to the data driving line input by the data driving circuit.

In addition, in order to achieve the above object, the present application also proposes a display device, and the display device includes a driving device of display panel.

In addition, in order to achieve the above object, the present application also proposes a storage medium in which a driving program of display panel is stored, and when the driving program is executed by a processor, the steps of the driving method of display panel as described above are implemented.

In the present application, at least three columns of pixel units are scanned as a driving period, the common electrodes of even row sub-pixels and odd row sub-pixels in adjacent columns of pixel units are driven with a preset voltage in the current driving period, and the sub-pixels in the pixel units do not need to be driven with double metal wiring and driving devices to achieve the purpose of cost saving, and when the first preset voltage and the second preset voltage meet preset conditions, the preset sub-pixels in the pixel units are driven according to data driving signals input by a data driving circuit. Thereby, the sub-pixels in the pixel unit are arranged in a manner of high and low voltage crossover, thereby achieving the purpose of solving the visual role deviation.

BRIEF DESCRIPTION OF THE ACCOMPANYING DRAWINGS

FIG. 1*a* is a relationship graph between the color shift curve and the ideal curve before improving;

FIG. 1*b* is a relationship graph between the color shift curve and the ideal curve after improving;

FIG. 2 is a schematic structural diagram of a display device of a hardware operating environment of the embodiments in accordance with this disclosure;

FIG. 3*a* is a schematic structural diagram of an exemplary display array in accordance with an embodiment;

FIG. 3*b* is a driving timing diagram of an exemplary display array;

FIG. 4*a* is a schematic structural diagram of an embodiment in accordance with this disclosure;

FIG. 4*b* is a driving timing diagram of an embodiment in accordance with this disclosure;

Various implementations, functional features, and advantages of this disclosure will now be described in further detail in connection with some illustrative embodiments and the accompanying drawings.

DETAILED DESCRIPTION OF ILLUSTRATIVE EMBODIMENTS

It is understood that the specific embodiments described herein are merely illustrative of the disclosure and are not intended to limit the disclosure.

Figure 1A:
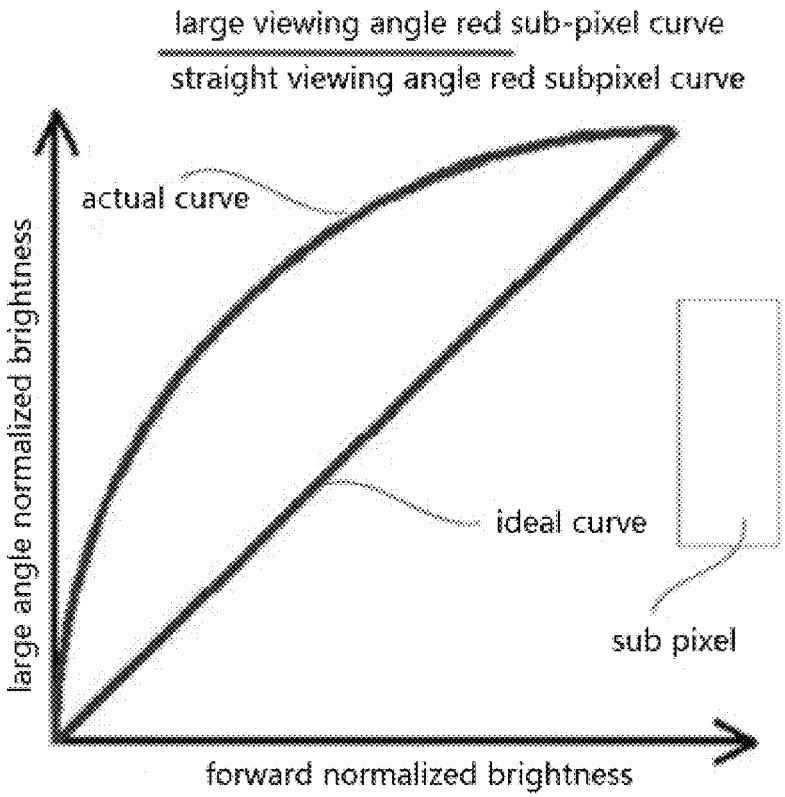
Figure 1B:
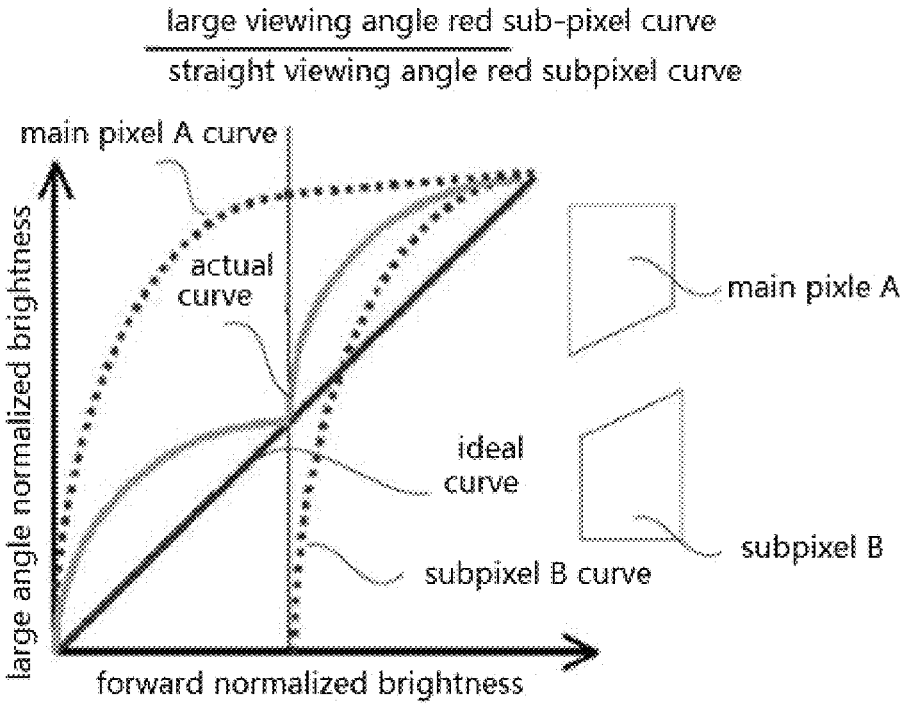
Figure 2:
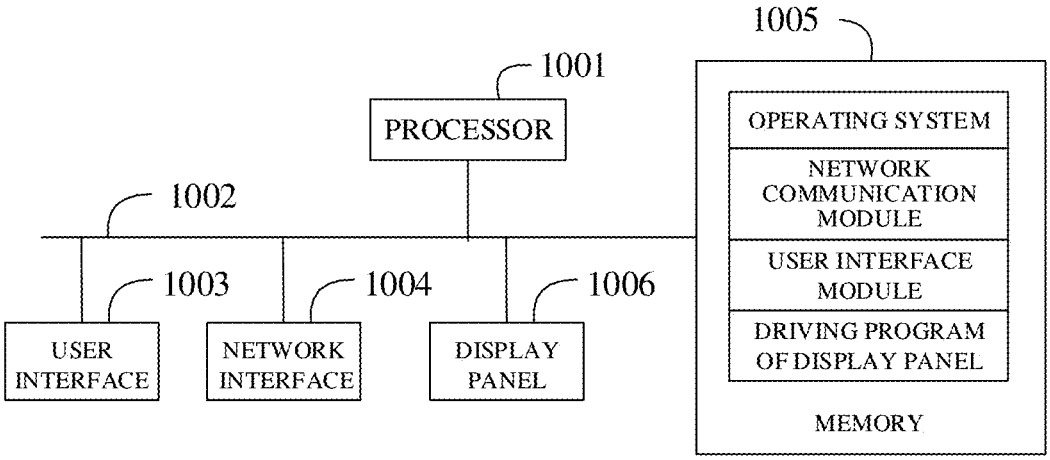

Referring to FIG. 2, FIG. 2 is a schematic structural diagram of a display panel of a hardware operating environment according to an embodiment of the present application.

As shown in FIG. 2, the display panel may include a processor 1001, such as a CPU, a communication bus 1002, user interface 1003, network interface 1004, and memory 1005. The communication bus 1002 is used to implement connection communication between these components. The user interface 1003 may include a display, an input unit such as a keyboard, and the optional user interface 1003 may also include a standard wired interface and a wireless interface. The network interface 1004 may optionally include a standard wired interface, a wireless interface (such as a Wi-Fi interface). The memory 1005 may be a high-speed RAM memory or a non-volatile memory, such as a magnetic disk memory. The memory 1005 may alternatively be a storage device independent of the aforementioned processor 1001, and the display panel 1006 may be a liquid crystal display panel or other display panels capable of performing the same or similar functions.

It will be understood by those skilled in the art that the display panel structure shown in FIG. 2 does not constitute a definition of the display panel and may include more or fewer components than shown, or some components may be combined, or different part arrangements may be used.

As shown in FIG. 2, the memory 1005 as a storage medium may include an operating system, a network communication module, a user interface module, and a driver for a display panel.

In the display panel shown in FIG. 2, the network interface 1004 is mainly used to connect the network and communicate data with the internet; the user interface 1003 is mainly used to connect the user terminal and communicate data with the terminal. The processor 1001 and the memory 1005 in the display panel of the present application may be provided in a data driving integrated circuit that calls the driving sequence of the display panel stored in the memory 1005 through the processor 1001 and performs the operation of the driving method of the display panel.

Based on the above hardware structure, an embodiment of the driving method for the display panel of the present application is proposed.

Figure 3A:
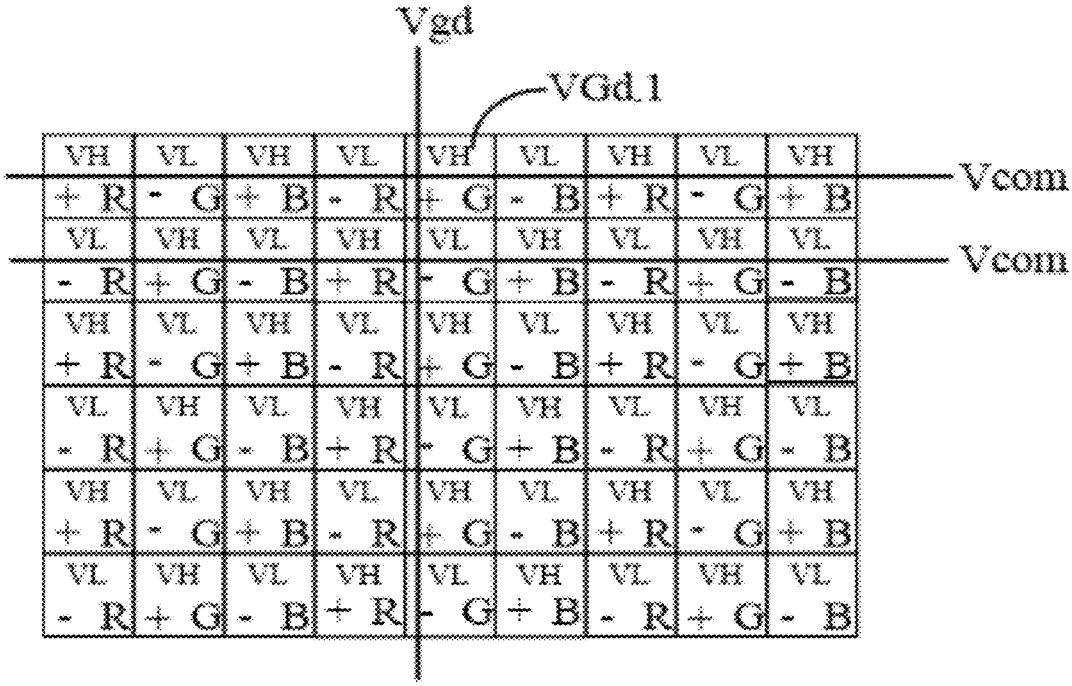
Figure 3B:
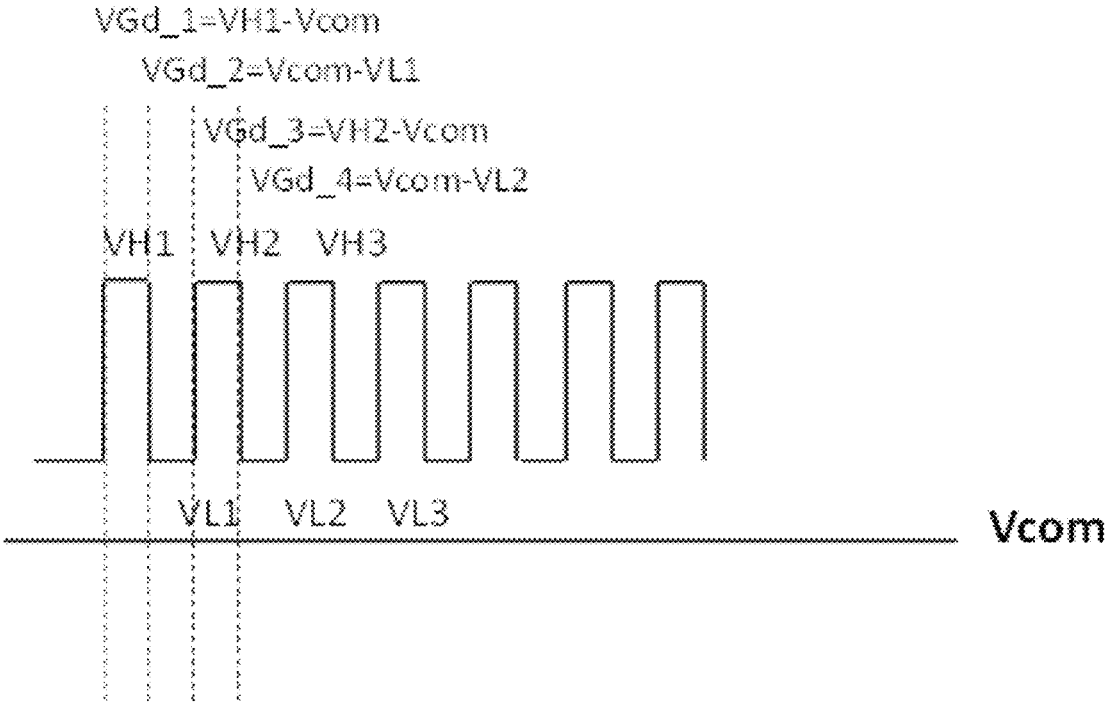

Referring to FIG. 3*a* as an example of the structure of the display array, the common electrode of the original liquid crystal display pixel is designed to pass through the same row of sub-pixels in the same row direction parallel to the gate electrode, as shown in FIG. 3*b* as an example of the driving timing diagram of the display array, the common electrode voltage is a fixed voltage value, and in order to achieve the effect of color shift improvement through high voltage sub-pixels and low voltage sub-pixels, the driving voltage Vd is sequentially driven according to the required voltage of each sub-pixel, as shown in FIG. 3*a*, the equivalent driving voltage VGd_1 of the high voltage sub-pixel is the voltage difference between the driving voltage VH1 and the common electrode Vcom, that is VGd_1=VH1−Vcom. The next adjacent low voltage sub-pixel VGd_2 is the voltage difference between the driving voltage VL1 and the common electrode Vcom, that is, VGd_2=VL1−Vcom, similarly driven by the high voltage and low voltage sub-pixels, as shown in FIG. 3*b*. The voltage driving frequency is VH1, VL1, VH2, VL2 . . . , which is the number of sub-pixel frequency switching of the display column. Therefore, if the display increases with the resolution, the voltage driving frequency of the driving voltage of the same row of pixels will increase. Since the driving signals of the high-voltage sub-pixels and the low-voltage sub-pixels are different, if the adjacent sub-pixels adopt the traditional positive and negative polarity driving method, the driving amplitude of the adjacent sub-pixels will increase, the driving frequency will increase and the driving amplitude will directly cause the power consumption and temperature of driving IC to increase, and the charging ability of pixel formation may decrease, directly reflecting the decrease of the brightness of the panel.

Figure 4A:
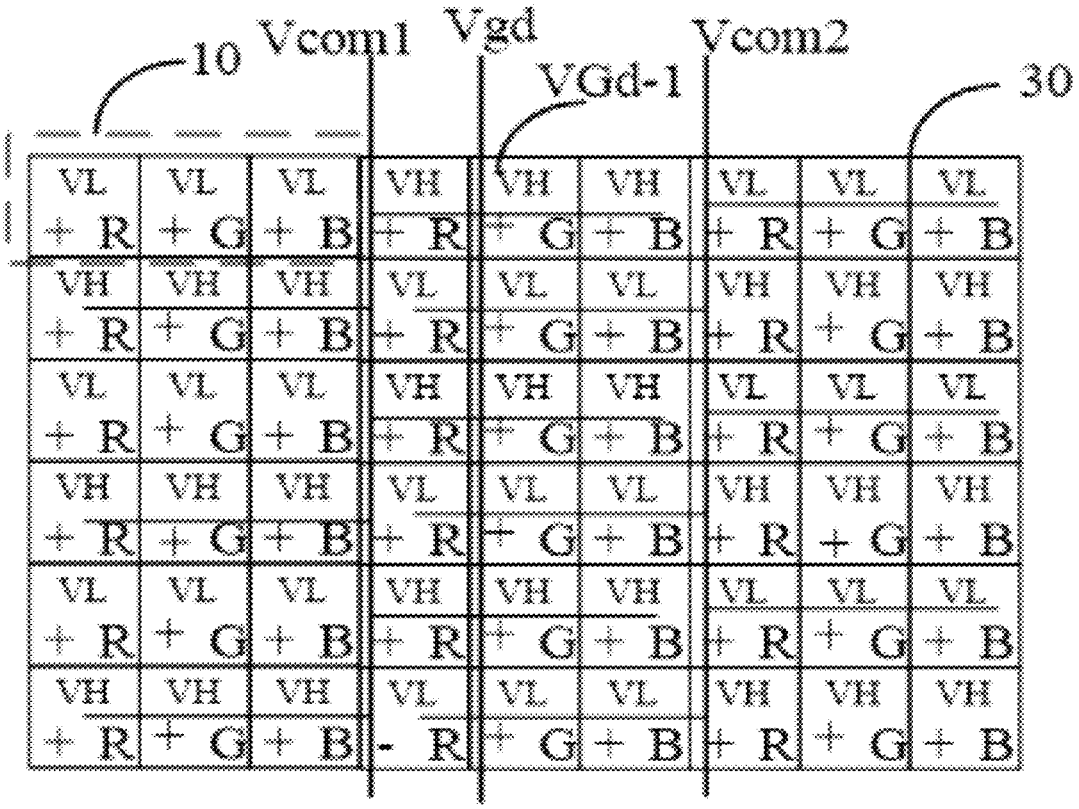
Figure 4B:
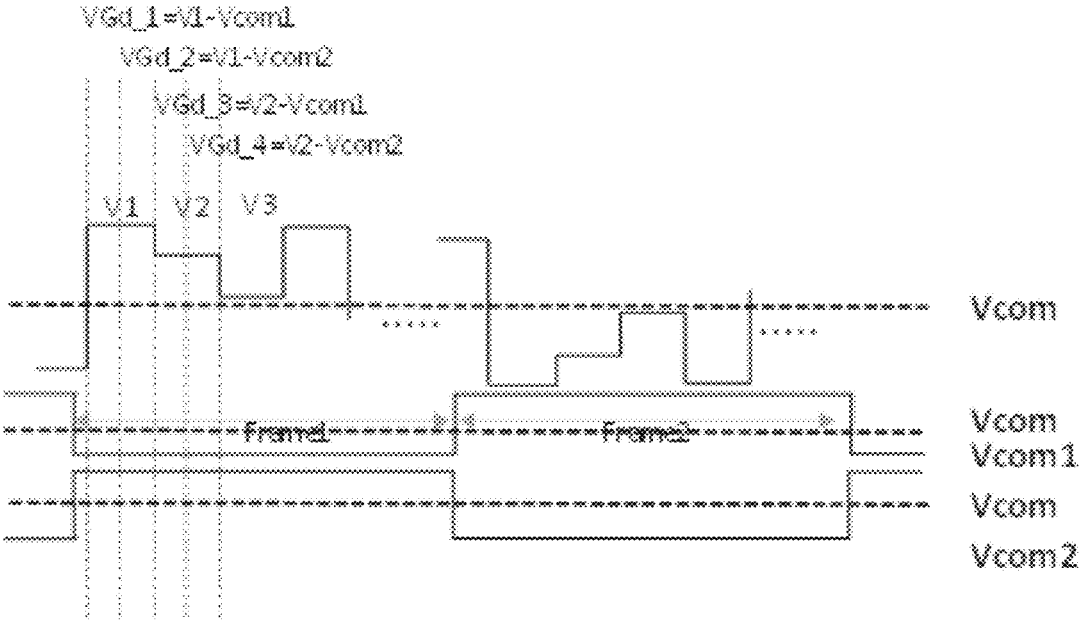

Reference is made to FIG. 4*a*, which is a structural diagram of an embodiment of the display array. FIG. 4*b* is a driving timing diagram corresponding to the display array of this embodiment. The display panel of the display array 30 may be a liquid crystal display panel or other display panels capable of realizing the same or similar functions. This embodiment is not limited to this. In this embodiment, the liquid crystal display panel is taken as an example, and the display panel includes a display array including pixel cells 10 arranged in an array, and the pixel cells 10 include a first sub-pixel, a second sub-pixel and a third sub-pixel in a first direction. The three sub-pixels of the pixel unit 10 are respectively aligned in the second direction according to the order of the arrangement, and the first sub-pixel, the second sub-pixel, and the third sub-pixel respectively correspond to a red sub-pixel (R), a green sub-pixel (G), and a blue sub-pixel (B), the first direction is a row direction and the second direction is a column direction.

Figure 5:
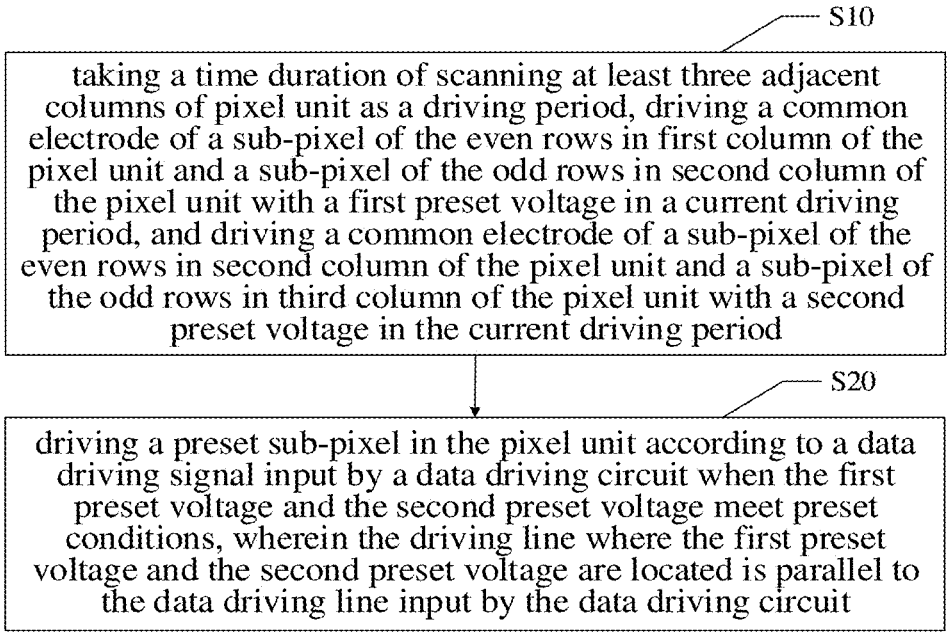
FIG. 5 is a structural diagram of another embodiment of the display array in accordance with this disclosure.

Referring to FIG. 5, FIG. 5 is a flowchart of the first embodiment of the driving method of the display panel of the present application.

In the first embodiment, the driving method of the display panel includes the following steps:

Step S10, taking a time duration of scanning at least three adjacent columns of pixel unit as a driving period, driving a common electrode of a sub-pixel of the even rows in first column of the pixel unit and a sub-pixel of the odd rows in second column of the pixel unit with a first preset voltage in a current driving period, and driving a common electrode of a sub-pixel of the even rows in second column of the pixel unit and a sub-pixel of the odd rows in third column of the pixel unit with a second preset voltage in the current driving period.

As shown in FIG. 4*a*, sub-pixels of even rows in the first column are connected to the common electrodes of sub-pixels of odd rows in the second column of pixel cells by a first preset voltage Vcom 1, which connects sub-pixels of even rows in the second column of pixel cells with the common electrodes of sub-pixels of odd rows in the third column of pixel cells, and is driven by a second preset voltage Vcom 1, Connecting the sub-pixels of the even rows of the pixel cells of the second column to the common electrodes of the sub-pixels of the odd rows of the third column of pixel cells, and driving by a second preset voltage, the second preset voltage is Vcom2.

Step S20, driving a preset sub-pixel in the pixel unit according to a data driving signal input by a data driving circuit when the first preset voltage and the second preset voltage meet preset conditions, wherein the driving line where the first preset voltage and the second preset voltage are located is parallel to the data driving line input by the data driving circuit.

It should be noted that the preset condition is the state when the first preset electrode and the second preset electrode are driven, for example, when the first preset voltage is a positive driving voltage, the second preset voltage is a negative driving voltage, or the first preset voltage is a negative driving voltage, and the second preset voltage is a positive driving voltage, the polarity of the first preset voltage is opposite to the polarity of the second preset voltage, and the design of the common electrode of the sub-pixel is different from the traditional design method of parallel to the scanning driving line and is parallel to the data driving line.

In the concrete implementation, the preset driving signal is used to drive in a row when the first preset voltage is a positive driving voltage and the second preset voltage is a negative driving voltage, the corresponding data driving signal is a negative driving signal, and when the first preset voltage is a negative driving voltage and the second preset voltage is a positive driving voltage, the data driving signal is a positive driving signal, so as to ensure that adjacent sub-pixels are interspersed with high and low voltages, thereby achieving the purpose of reducing color shift.

Further, if the first preset voltage is a negative polarity driving voltage and the second preset voltage is a positive polarity driving voltage, driving the high voltage sub-pixels in the first row and the second row of the pixel unit in a positive polarity and driving the low voltage sub-pixels in the second row and the third row of the pixel unit in a positive polarity, the first preset voltage is less than a reference voltage and the second preset voltage is greater than the reference voltage.

Inverting the first preset voltage and the second preset voltage periodically when the received data driving signal input by the data driving circuit is inverted.

If the inverted first preset voltage is a positive polarity driving voltage and the inverted second preset voltage is a negative polarity driving voltage, driving the high voltage sub-pixels in the first row and the second row of pixel units in a negative polarity, and driving the low voltage sub-pixels in the second row and the third row of pixel units in a negative polarity, wherein the inverted first preset voltage is larger than the reference voltage, and the inverted second preset voltage is less than the reference voltage.

As shown in FIG. 4*a*, it should be noted that this embodiment adopts a frame inversion method, in which the common electrode voltage corresponding to the high voltage driving signals of the red, green and blue subpixels of the first and second columns is Vcom1 negative polarity driving voltage, the common electrode voltage Vcom1, which is the negative polarity of the common electrode voltage, is smaller than the original common electrode voltage Vcom, i.e., Vcom1<Vcom, the common electrode voltage corresponding to the low voltage driving signals of the second and third columns is Vcom2 positive polarity driving voltage. The common electrode voltage positive polarity, that is, the common electrode voltage Vcom2 is larger than the original common electrode voltage Vcom, that is, Vcom2>Vcom, and the common electrode voltages Vcom1 and Vcom2 are alternately interspersed on the pixels. As the data drive signal is inverted, the common electrode voltage is also switched as the polarity of the sub-pixel drive signal is switched. The common electrode voltage corresponding to the first and second columns of high voltage driving signals is Vcom1 positive driving voltage, the common electrode voltage Vcom1 positive driving voltage is larger than the original common electrode voltage Vcom1, i.e., Vcom1>Vcom. The common electrode voltage corresponding to the low voltage driving signals of the second column and the third column is the Vcom2 negative polarity driving voltage, and the common electrode voltage negative polarity, that is, the common electrode voltage Vcom2 is smaller than the original common electrode voltage Vcom, that is, Vcom2<Vcom, thereby Ensuring that the equivalent voltage VGd_1=|V1−Vcom1| of the high voltage sub-pixel VGd_1 corresponding to the common electrode voltage Vcom1 at any one time is higher than the equivalent voltage VGd_2=|V1−Vcom2| of the common electrode voltage Vcom2 of the low voltage sub-pixel VGd_2, thereby It is ensured that adjacent sub-pixels are interspersed with high and low voltages, thereby achieving the purpose of reducing color shift.

Further, if the first preset voltage is a negative polarity driving voltage and the second preset voltage is a positive polarity driving voltage, driving the red low voltage negative sub-pixels, the blue low voltage negative sub-pixels and the green high voltage positive sub-pixels in the first row and the second row of the pixel unit, and driving the red high voltage negative sub-pixels, the blue high voltage negative sub-pixels and the green low voltage positive sub-pixels in the second row and the third row of the pixel unit, wherein the first preset voltage is less than a reference voltage and the second preset voltage is greater than the reference voltage.

Inverting the first preset voltage and the second preset voltage periodically when the received data driving signal input by the data driving circuit is inverted.

If the inverted first preset voltage is a positive polarity driving voltage and the inverted second preset voltage is a negative polarity driving voltage, the red low voltage positive sub-pixel, the blue low voltage positive sub-pixel and the green high voltage negative sub-pixel in the first row and the second row of the pixel unit, and driving the red high voltage positive sub-pixel, the blue high voltage positive sub-pixel and the green low voltage negative sub-pixel in the second row and the third row of the pixel unit, wherein the inverted first preset voltage is greater than the reference voltage, and the inverted second preset voltage is less than the reference voltage.

Figure 6:
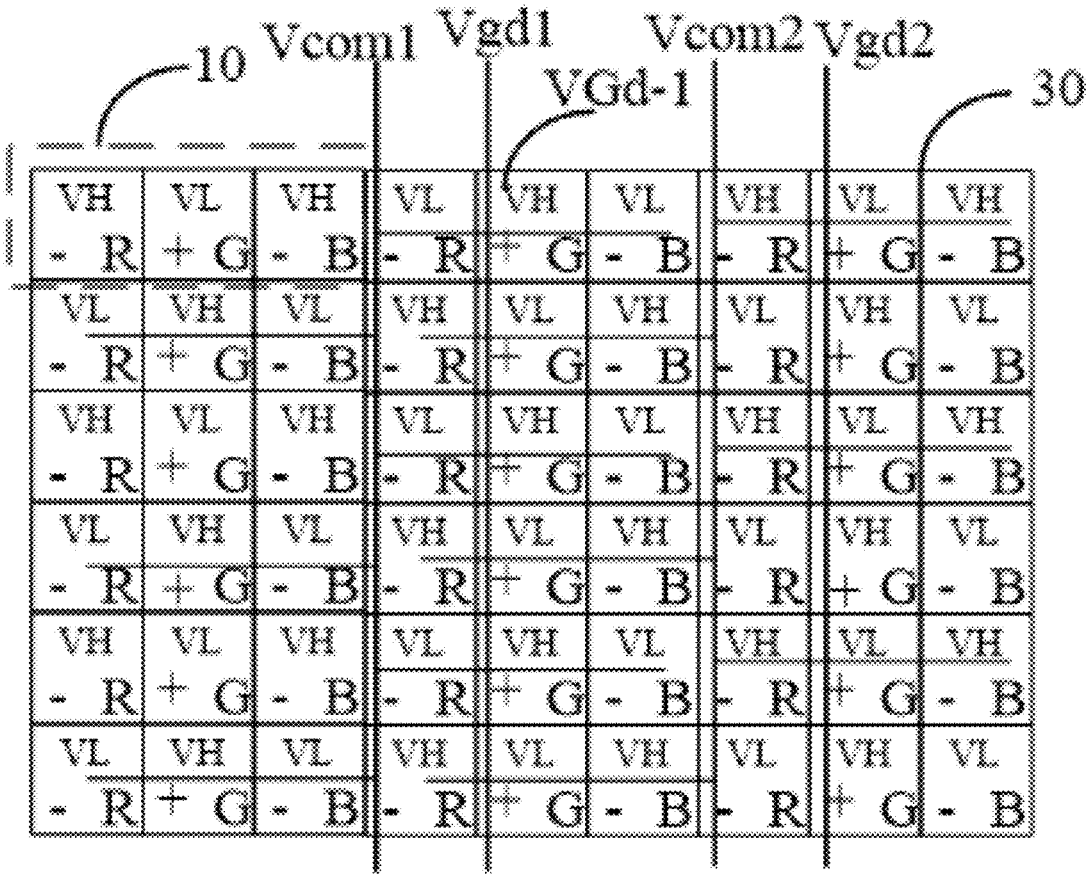
FIG. 6 is a flowchart of an embodiment of the driving method of display panel in accordance with this disclosure.

As shown in FIG. 6, a schematic structural diagram of a display array according to another embodiment is provided. The common electrode voltage corresponding to the R and B low voltage negative polarity sub-pixels of the first column and the second column and the G high voltage positive polarity sub-pixel is the Vcom1 negative polarity driving voltage, and the common electrode voltage negative polarity, that is, the common electrode voltage Vcom1 is relative to the original common electrode. The voltage Vcom is small, that is, Vcom1<Vcom. The R, G, and B line sub-pixels of the second column and the third column, the common electrode voltage corresponding to the R, B high-voltage negative polarity sub-pixel of the six-row sub-pixel and the G low-voltage positive polarity sub-pixel is the Vcom2 positive polarity driving voltage, The common electrode voltage positive polarity, that is, the common electrode voltage Vcom2 is larger than the original common electrode voltage Vcom, that is, Vcom2>Vcom, and the common electrode voltages Vcom1 and Vcom2 are alternately interspersed on the pixels. With the inversion of the data driving signal, the common electrode voltage also switches in rows with the switching of the polarity of the sub-pixel driving signal. The common electrode voltage corresponding to the R and B low voltage positive polarity sub-pixels of the first column and the second column and the G high voltage negative polarity sub-pixel is the Vcom1 positive polarity driving voltage, and the common electrode voltage positive polarity, that is, the common electrode voltage Vcom1 is relative to the original common electrode. The voltage Vcom is large, that is, Vcom1>Vcom. The common electrode voltage corresponding to the R and B high voltage positive polarity sub-pixels of the second column and the third column and the G low voltage negative polarity sub-pixel is the Vcom2 negative polarity driving voltage, and the common electrode voltage negative polarity, that is, the common electrode voltage Vcom2 is relative to the original The electrode voltage Vcom is small, that is, Vcom2<Vcom. It is ensured that the equivalent voltage VGd_1=|V1−Vcom1| of the high voltage sub-pixel VGd_1 corresponding to the common electrode voltage Vcom1 at any one time is higher than the equivalent voltage VGd_2=|V1−Vcom2| of the common electrode voltage Vcom2 of the low voltage sub-pixel VGd_2. Similarly, the equivalent voltage VRd_1=|V1−Vcom1| of the low voltage sub-pixel VRd_1 corresponding to the common electrode voltage Vcom1 is lower than the equivalent voltage VRd_2=|V1−Vcom2| of the high voltage sub-pixel VRd_2 corresponding to the common electrode voltage Vcom2.

For example, the R and B sub-pixels of the first column and the second column of frame1 are low voltage negative polarity and G is high voltage positive polarity driving is driven by Vcom1 negative common electrode voltage. The middle R and B sub-pixels of the second and third columns are high voltage negative polarity and G is low voltage positive polarity drive is driven by Vcom2 positive common electrode voltage. The driving voltage of the green sub-pixel in the second column is Vgd1, and the high voltage sub-pixel of the column is VGd_1=|V1−Vcom1|, low voltage sub-pixel VGd_2=|V1−Vcom2|, where V1 is a positive polarity driving voltage, V1>Vcom and Vcom1<Vcom<Vcom2, so VGd_1>VGd_2. The driving voltage of the green sub-pixel in the third column is Vgd2, the high voltage pixel VGd_2=|V1−Vcom1| of the column, and the low voltage pixel VGd_1=|V1−Vcom2|, where V1 is the positive driving voltage, V1>Vcom and Vcom1<Vcom<Vcom2, so VGd_2>VGd_1.

Similarly, the drive voltage Vrd1 of the same column of R in the second column, the high voltage sub-pixel VRd_2=|V1'−Vcom2| of the column, the low voltage sub-pixel VRd_1=|V1'−Vcom1|, where V1' is negatively driven The voltage V1'<Vcom and Vcom1<Vcom<Vcom2, so VRd_1<VRd_2. The driving voltage Vrd2 of the R column of the third column, the row obtaining the high voltage pixel VRd_=|V1'−Vcom2|, and the low voltage pixel VRd_2=|V1'−Vcom1|, where V1' is the negative polarity drive power V1'<Vcom and Vcom1<Vcom<Vcom2, so VRd_1>VRd_2.

Similarly, the driving voltage Vbd1 of column B in the second column, the column high voltage pixel VBd_2=|V1'−Vcom2|, the low voltage pixel VBd_1=|V1'−Vcom1|, wherein V1' negative polarity driving voltage V1'<Vcom and Vcom1<Vcom<Vcom2, so VBd_1<VBd_2. The column B driving voltage Vbd2 in the third column has a high voltage pixel VBd_1=|V1'−Vcom2|, and a low voltage pixel VBd_2=|V1'−Vcom1|, where V1' is a negative driving power V1'<Vcom and Vcom1<Vcom<Vcom2, so VBd_1>VBd_2.

When receiving the data drive signal inversion, periodically inverting the first preset voltage and the second preset voltage.

Referring to FIG. 4*a*, in frame 1, the common electrode voltage Vcom1 corresponding to the G column sub-pixel high voltage sub-pixels VGd_1, VGd_3, and VGd_5 is a negative polarity driving voltage, and the common electrode voltage negative polarity, that is, the common electrode voltage Vcom1 is compared with the original common electrode voltage Vcom. Small, that is, Vcom1<Vcom. The common electrode voltage Vcom2 corresponding to the low voltage subpixels VGd_2, VGd_4, and VGd_6 is a positive polarity driving voltage, and the common electrode voltage positive polarity, that is, the common electrode voltage Vcom2 is larger than the original common electrode voltage Vcom, that is, Vcom2>Vcom. The high voltage sub-pixels VGd_1, VGd_3, VGd_5 and the low-voltage sub-pixels VGd_2, VGd_4, and VGd_6 are positive driving voltages.

With the reversal of the driving signal, the common electrode voltage is also switched with the polarity of the driving reversal frame to switch the periodic voltage, that is, the common electrode voltage Vcom1 becomes the positive driving voltage, and the common electrode voltage positive polarity is the common electrode voltage Vcom1 Relative to the original common electrode voltage Vcom is large, that is, Vcom1>Vcom. The common electrode voltage Vcom2 becomes a negative polarity driving voltage, and the common electrode voltage negative polarity, that is, the common electrode voltage Vcom2 is smaller than the original common electrode voltage Vcom, that is, Vcom2<Vcom, and the high voltage sub-pixels VGd_1, VGd_3, VGd_5 and the low voltage. The sub-pixels VGd_2, VGd_4, and VGd_6 are negative driving voltages.

As shown in FIG. 4*b*, when the timing is frame 2 frame switching, the first column R, G, B sub-pixel high and low voltage interpolated drive arrangement mode, the high voltage sub-pixel is negative polarity drive, and the low voltage unit pixel is positive polarity drive, With the common electrode voltage positive polarity voltage driving, the common electrode voltage Vcom1 is larger than the original common electrode voltage Vcom, that is, Vcom1>Vcom. The R, G, and B sub-pixels of the next column are high and low voltage interleaved driving arrangements, the high voltage sub-pixel is driven by the positive polarity, the low voltage sub-pixel is driven by the negative polarity, and the common electrode voltage is driven by the negative voltage, and the common electrode voltage Vcom2 is relatively The original common electrode voltage Vcom is small, that is, Vcom2<Vcom). Accordingly, the sub-pixels and the common electrode voltages sequentially inserted in the respective columns are driven.

This embodiment solves the technical problem of large wide-angle color shift by adopting a positive and negative polarity timing switching driving mode for common electrode voltage relative to the original common electrode, and driving preset sub-pixels in matching adjacent pixel units in a high and low voltage interleaving arrangement, and driving by reversing common electrode voltage instead of driving devices, thereby reducing the operation of the driving chip, reducing the power consumption of the driving chip, and eliminating the need to double the metal wiring and driving devices to drive sub-pixels, thus achieving the goal of cost saving.

Further, selecting two adjacent sub-pixels in the same row respectively, driving a high voltage sub-pixel and a low voltage sub-pixel in the selected sub-pixels by the same positive polarity driving voltage.

In this embodiment, when the data driving signal is positive driving, adjacent sub-pixels in the same column share the same driving signal, so that adjacent sub-pixels in the same column are driven with the same data driving signal, thereby reducing the driving frequency of the data driving signal by half and reducing the power consumption of the driving chip.

Further, the operation of driving a preset sub-pixel in the pixel unit according to a data driving signal input by a data driving circuit when the first preset voltage and the second preset voltage meet preset conditions includes:

when the first preset voltage and the second preset voltage meet preset conditions, driving an equivalent driving voltage of a high voltage sub-pixel and a low voltage sub-pixel in the selected sub-pixels by a preset data driving signal, and the preset data driving signal is an average signal of driving signals of two adjacent sub-pixels in one original same row.

In a specific implementation, as shown in FIG. 4*b*, the high voltage positive polarity driving signal of the G column Vgd=V1, V2, V3 . . . , the high voltage negative polarity dynamic signal Vgd=V1', V2', V3' . . . (V1, V2, V3 . . . >Vcom, V1', V2', V3' . . . <Vcom).

In this embodiment, VGd_1 and VGd_2 share the driving voltage Vd1=V1. The positive driving voltage may preferably be an average signal of the original pixel signals Gd1 and Gd2 signals to 8 Bit drive signal is 0-255 signal, that is, G1=(Gd1+Gd2)/2, G1 corresponds to the positive polarity driving voltage V1, and the negative polarity driving voltage is V1'. VGd_3 and VGd_4 shared driving voltage Vd1=V2, that is, a positive driving voltage, which may preferably be the average signal of the original pixel signal Gd3 and the Gd4, like 0-255 signal for the 8-bit drive signal, that is, G2=(Gd3+Gd4)/2, G2 corresponds to the positive polarity driving voltage V2, and the negative polarity driving voltage V2'. Two adjacent high and low voltage sub-pixel driving voltage sharing and frame inversion driving mode greatly reduce the frequent switching of the driving signal, and the direct driving frequency is reduced to ½, which can reduce the operation of the driving IC and reduce the driving IC. The power consumption and the temperature rise risk of the driver IC.

Further, driving the high voltage sub-pixel in the selected sub-pixels with an equivalent driving voltage larger than that of the low voltage sub-pixel in the selected sub-pixels.

In a specific implementation, when the frame1 frame is timed, the high voltage sub-pixel equivalent driving voltage is VGd_1, That is, the voltage difference between the positive polarity driving voltage Vgd=V1 (V1>Vcom) and the negative polarity common electrode power Vcom1, that is, VGd_1=|V1−Vcom1|, the next adjacent low voltage sub-pixel VGd_2 is the positive polarity driving voltage Vgd=V1 (V1>Vcom) and positive polarity common electrode electric Vcom2 (Vcom2>Vcom), which is VGd_2=|V1−Vcom2|, so VGd_1>VGd_2. Similarly, the high voltage sub-pixel equivalent driving voltage VGd_3 is driven by the high voltage sub-pixel VGd_3 and the low voltage sub-pixel VGd_4. The positive driving voltage Vgd=V2 (V2>Vcom) and the negative polarity common electrode electric Vcom1 (Vcom1<Vcom) the pressure difference, that is, VGd_3=|V2−Vcom1|. The next adjacent low voltage sub-pixel VGd_4 is the voltage difference between the positive polarity driving voltage Vgd=V2 (V2>Vcom) and the positive polarity common electrode electric power Vcom2 (Vcom2>Vcom), that is, VGd_4=|V2−Vcom2|, so VGd_3>VGd_4, thereby realizing switching between high and low voltages between adjacent sub-pixels, and adopting a driving method of column inversion for sub-pixels in the display array, thereby achieving the purpose of reducing color shift.

In this embodiment, after scanning at least three columns of pixel units as a driving period, the common electrodes of the even-numbered sub-pixels and the odd-numbered sub-pixels in the pixel unit of the adjacent column are driven by a preset voltage in the current driving period, and It is not necessary to double the metal traces and driving devices to drive the sub-pixels, thereby achieving the purpose of cost saving, and when the first preset voltage and the second preset voltage satisfy a preset condition, the pixel unit is The preset sub-pixels are driven according to the data driving signal input by the data driving circuit, so that the sub-pixels in the pixel unit are arranged in a high-low voltage crossover manner, thereby achieving the purpose of solving the visual role deviation.

Figure 7:
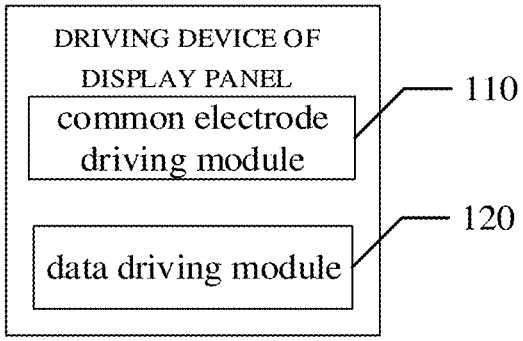
FIG. 7 is a schematic structural diagram of an embodiment of the display device in accordance with this disclosure.

In addition, the embodiment of the application also provides a display device. As shown in FIG. 7, the display device includes:

A common electrode driving module 110, being configured to taking a time duration of scanning at least three adjacent columns of pixel unit as a driving period, driving a common electrode of a sub-pixel of the even rows in first column of the pixel unit and a sub-pixel of the odd rows in second column of the pixel unit with a first preset voltage in a current driving period, and driving a common electrode of a sub-pixel of the even rows in second column of the pixel unit and a sub-pixel of the odd rows in third column of the pixel unit with a second preset voltage in the current driving period.

A data driving module 120, being configured to drive a preset sub-pixel in the pixel unit according to a data driving signal input by a data driving circuit when the first preset voltage and the second preset voltage meet preset conditions, wherein the driving line where the first preset voltage and the second preset voltage are located is parallel to the data driving line input by the data driving circuit.

Figure 8:
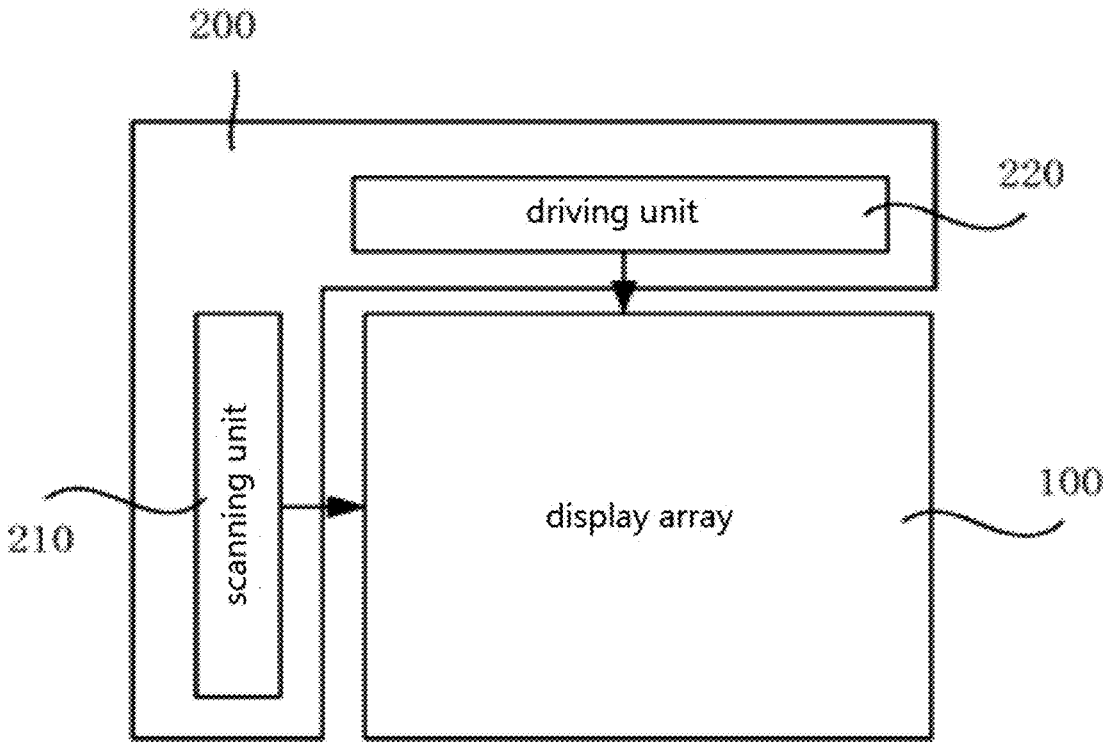
FIG. 8 is a structural diagram of another embodiment of the driving device of display panel in accordance with this disclosure.

As shown in FIG. 8, the driving device of the display panel also includes a display array 100 and a driving module 200. The driving module 200 may include a scanning unit 210 and a driving unit 220. The scanning unit 210 is used to output scanning signals, typically scanning pixel units line by line, and the driving unit 220 outputs driving signals so that pixel units receive driving data for display when scanned.

The driving module 200 can refer to the above embodiment, after this process, at least three columns of pixel cells can be scanned as a driving period, and the common electrodes of even rows of sub-pixels and odd rows of sub-pixels in adjacent columns are driven with preset voltages in the current driving period, without doubling the number of metal traces and driving devices to drive sub-pixels, so as to achieve the goal of cost saving. When the first preset voltage and the second preset voltage meet preset conditions, the preset sub-pixels in the pixel cells are driven according to the data driving signals input by the data driving circuit.

In addition, the embodiment of the present application also provides a storage medium on which the driver of the display panel is stored, and when the driver of the display panel is executed by the processor, the driver of the display panel as described above driving method.

The above is only the preferred embodiment of the present application and is not therefore limiting the scope of the patent of the present application. The equivalent structure or equivalent process changes made in the application specification and drawings, or directly or indirectly applied in other related technical fields, are similarly included in the patent protection scope of this application.

What is claimed is:

1. A driving method of display panel, wherein the display panel comprises a display array, the display array comprises pixel units arranged in an array, the pixel unit comprises a first sub-pixel, a second sub-pixel, and a third sub-pixel in a first direction, and the three sub-pixels of the pixel unit are respectively aligned in a second direction according to an arrangement order; wherein the driving method comprises:

taking a time duration of scanning at least three adjacent columns of pixel unit as a driving period, driving a common electrode of a sub-pixel of the even rows in first column of the pixel unit and a sub-pixel of the odd rows in second column of the pixel unit with a first preset voltage in a current driving period, and driving a common electrode of a sub-pixel of the even rows in second column of the pixel unit and a sub-pixel of the odd rows in third column of the pixel unit with a second preset voltage in the current driving period; and driving a preset sub-pixel in the pixel unit according to a data driving signal input by a data driving circuit when the first preset voltage and the second preset voltage meet preset conditions, wherein the driving line where the first preset voltage and the second preset voltage are located is parallel to the data driving line input by the data driving circuit, adjacent pixel units are pixel units with alternating high and low voltages of the same polarity;

wherein driving a preset sub-pixel in the pixel unit according to a data driving signal input by a data driving circuit when the first preset voltage and the second preset voltage meet preset conditions comprises:

if the first preset voltage is a negative polarity driving voltage and the second preset voltage is a positive polarity driving voltage, driving the high voltage sub-pixels in the first row and the second row of the pixel unit in a positive polarity and driving the low voltage sub-pixels in the second row and the third row of the pixel unit in a positive polarity, wherein the first preset voltage is less than a reference voltage and the second preset voltage is greater than the reference voltage;

inverting the first preset voltage and the second preset voltage periodically when the received data driving signal input by the data driving circuit is inverted; and if the inverted first preset voltage is a positive polarity driving voltage and the inverted second preset voltage is a negative polarity driving voltage, driving the high voltage sub-pixels in the first row and the second row of pixel units in a negative polarity, and driving the low voltage sub-pixels in the second row and the third row of pixel units in a negative polarity, wherein the inverted first preset voltage is larger than the reference voltage, and the inverted second preset voltage is less than the reference voltage.

2. The driving method of claim 1, wherein the pixel unit comprises a red sub-pixel, a blue sub-pixel, and a green sub-pixel, the red sub-pixel and the blue sub-pixel are sub-pixels of the same polarity, and the green sub-pixel is a sub-pixel of different polarity; and driving a preset sub-pixel in the pixel unit according to a data driving signal input by a data driving circuit when the first preset voltage and the second preset voltage meet preset conditions comprises:

if the first preset voltage is a negative polarity driving voltage and the second preset voltage is a positive polarity driving voltage, driving the red low voltage negative sub-pixels, the blue low voltage negative sub-pixels, and the green high voltage positive sub-pixels in the first row and the second row of the pixel unit, and driving the red high voltage negative sub-pixels, the blue high voltage negative sub-pixels, and the green low voltage positive sub-pixels in the second row and the third row of the pixel unit, wherein the first preset voltage is less than a reference voltage and the second preset voltage is greater than the reference voltage;

inverting the first preset voltage and the second preset voltage periodically when the received data driving signal input by the data driving circuit is inverted; and if the inverted first preset voltage is a positive polarity driving voltage and the inverted second preset voltage is a negative polarity driving voltage, driving the red low voltage positive sub-pixel, the blue low voltage positive sub-pixel, and the green high voltage negative sub-pixel in the first row and the second row of the pixel unit, and driving the red high voltage positive sub-pixel, the blue high voltage positive sub-pixel, and the green low voltage negative sub-pixel in the second row and the third row of the pixel unit, wherein the inverted first preset voltage is greater than the reference voltage, and the inverted second preset voltage is less than the reference voltage.

3. The driving method of claim 1, wherein prior to inverting the first preset voltage and the second preset voltage periodically when the received data driving signal input by the data driving circuit is inverted, the driving method further comprising:

selecting two adjacent sub-pixels in the same row, driving a high voltage sub-pixel and a low voltage sub-pixel in the selected sub-pixels by the same positive polarity driving voltage.

4. The driving method of claim 3, wherein driving a preset sub-pixel in the pixel unit according to a data driving signal input by a data driving circuit when the first preset voltage and the second preset voltage meet preset conditions comprises:

when the first preset voltage and the second preset voltage meet preset conditions, driving an equivalent driving voltage of a high voltage sub-pixel and a low voltage sub-pixel in the selected sub-pixels by a preset data driving signal, and the preset data driving signal is an average signal of driving signals of two adjacent sub-pixels in one original same row.

5. The driving method of claim 3, wherein subsequent to the inverted preset voltage being a positive polarity driving voltage, the driving method further comprising:

driving the high voltage sub-pixel in the selected sub-pixels with an equivalent driving voltage larger than that of the low voltage sub-pixel in the selected sub-pixels.

6. The driving method of claim 1, wherein prior to taking a time duration of scanning at least three adjacent columns of pixel unit as a driving period, the driving method further comprising:

configuring a first sub-pixel, a second sub-pixel, and a third sub-pixel in the row direction of the pixel unit, wherein the first sub-pixel, the second sub-pixel, and the third sub-pixel are respectively corresponding to a red sub-pixel, a green sub-pixel, and a blue sub-pixel.

7. The driving method of claim 6, wherein prior to taking a time duration of scanning at least three adjacent columns of pixel unit as a driving period, the driving method further comprising:

aligning the first sub-pixel, the second sub-pixel, and the third sub-pixel respectively in the column direction according to an arrangement order.

8. The driving method of claim 6, wherein prior to taking a time duration of scanning at least three adjacent columns of pixel unit as a driving period, the driving method further comprising:

setting two adjacent sub-pixels in the pixel unit as sub-pixels with the same polarity or as sub-pixels with different polarities.

9. The driving method of claim 1, wherein subsequent to driving a preset sub-pixel in the pixel unit according to a data driving signal input by a data driving circuit when the first preset voltage and the second preset voltage meet preset conditions, the driving method further comprising:

driving the sub-pixels in the display array with a column inversion driving mode.

10. A driving device of display panel, wherein the driving device comprises a processor and a non-volatile memory, the non-volatile memory stores executable instructions, the processor executes the executable instructions, and the executable instructions comprise:

a common electrode drive, for taking a time duration of scanning at least three adjacent columns of pixel unit as a driving period, driving a common electrode of a sub-pixel of the even rows in first column of the pixel unit and a sub-pixel of the odd rows in second column of the pixel unit with a first preset voltage in a current driving period, and driving a common electrode of a sub-pixel of the even rows in second column of the pixel unit and a sub-pixel of the odd rows in third column of the pixel unit with a second preset voltage in the current driving period; and a data drive, for driving a preset sub-pixel in the pixel unit according to a data driving signal input by a data driving circuit when the first preset voltage and the second preset voltage meet preset conditions, wherein the driving line where the first preset voltage and the second preset voltage are located is parallel to the data driving line input by the data driving circuit if the first preset voltage is a negative polarity driving voltage and the second preset voltage is a positive polarity driving voltage, driving the high voltage sub-pixels in the first row and the second row of the pixel unit in a positive polarity and driving the low voltage sub-pixels in the second row and the third row of the pixel unit in a positive polarity, wherein the first preset voltage is less than a reference voltage and the second preset voltage is greater than the reference voltage;

inverting the first preset voltage and the second preset voltage periodically when the received data driving signal input by the data driving circuit is inverted; and if the inverted first preset voltage is a positive polarity driving voltage and the inverted second preset voltage is a negative polarity driving voltage, driving the high voltage sub-pixels in the first row and the second row of pixel units in a negative polarity, and driving the low voltage sub-pixels in the second row and the third row of pixel units in a negative polarity, wherein the inverted first preset voltage is larger than the reference voltage, and the inverted second preset voltage is less than the reference voltage.

11. The driving device of claim 10, wherein if the first preset voltage is a negative polarity driving voltage and the second preset voltage is a positive polarity driving voltage, driving the red low voltage negative sub-pixels, the blue low voltage negative sub-pixels and the green high voltage positive sub-pixels in the first row and the second row of the pixel unit, and driving the red high voltage negative sub-pixels, the blue high voltage negative sub-pixels and the green low voltage positive sub-pixels in the second row and the third row of the pixel unit, wherein the first preset voltage is less than a reference voltage and the second preset voltage is greater than the reference voltage;

inverting the first preset voltage and the second preset voltage periodically when the received data driving signal input by the data driving circuit is inverted; and if the inverted first preset voltage is a positive polarity driving voltage and the inverted second preset voltage is a negative polarity driving voltage, driving the red low voltage positive sub-pixel, the blue low voltage positive sub-pixel and the green high voltage negative sub-pixel in the first row and the second row of the pixel unit, and driving the red high voltage positive sub-pixel, the blue high voltage positive sub-pixel and the green low voltage negative sub-pixel in the second row and the third row of the pixel unit, wherein the inverted first preset voltage is greater than the reference voltage, and the inverted second preset voltage is less than the reference voltage.

12. The driving device of claim 10, wherein selecting two adjacent sub-pixels in the same row respectively, and driving a high voltage sub-pixel and a low voltage sub-pixel in the selected sub-pixels by the same positive polarity driving voltage.

13. The driving device of claim 12, wherein when the first preset voltage and the second preset voltage meet preset conditions, driving an equivalent driving voltage of a high voltage sub-pixel and a low voltage sub-pixel in the selected sub-pixels by a preset data driving signal, and the preset data driving signal is an average signal of driving signals of two adjacent sub-pixels in one original same row.

14. The driving device of claim 12, wherein driving the high voltage sub-pixel in the selected sub-pixels with an equivalent driving voltage larger than that of the low voltage sub-pixel in the selected sub-pixels.

15. The driving device of claim 10, wherein configuring a first sub-pixel, a second sub-pixel and a third sub-pixel in the row direction of the pixel unit, and the first sub-pixel, the second sub-pixel and the third sub-pixel are respectively corresponding to a red sub-pixel, a green sub-pixel and a blue sub-pixel.

16. The driving device of claim 15, wherein aligning the first sub-pixel, the second sub-pixel and the third sub-pixel respectively in the column direction according to an arrangement order.

17. The driving device of claim 15, wherein setting two adjacent sub-pixels in the pixel unit as sub-pixels with the same polarity or as sub-pixels with different polarities.

18. A display device, wherein the display device comprises a driving device of display panel, the driving device comprises a processor and a non-volatile memory, the non-volatile memory stores executable instructions, the processor executes the executable instructions, and the executable instructions comprise:

a common electrode drive, for taking a time duration of scanning at least three adjacent columns of pixel unit as a driving period, driving a common electrode of a sub-pixel of the even rows in first column of the pixel unit and a sub-pixel of the odd rows in second column of the pixel unit with a first preset voltage in a current driving period, and driving a common electrode of a sub-pixel of the even rows in second column of the pixel unit and a sub-pixel of the odd rows in third column of the pixel unit with a second preset voltage in the current driving period; and a data drive, drive for driving a preset sub-pixel in the pixel unit according to a data driving signal input by a data driving circuit when the first preset voltage and the second preset voltage meet preset conditions, wherein the driving line where the first preset voltage and the second preset voltage are located is parallel to the data driving line input by the data driving circuit if the first preset voltage is a negative polarity driving voltage and the second preset voltage is a positive polarity driving voltage, driving the high voltage sub-pixels in the first row and the second row of the pixel unit in a positive polarity and driving the low voltage sub-pixels in the second row and the third row of the pixel unit in a positive polarity, wherein the first preset voltage is less than a reference voltage and the second preset voltage is greater than the reference voltage;

inverting the first preset voltage and the second preset voltage periodically when the received data driving signal input by the data driving circuit is inverted; and if the inverted first preset voltage is a positive polarity driving voltage and the inverted second preset voltage is a negative polarity driving voltage, driving the high voltage sub-pixels in the first row and the second row of pixel units in a negative polarity, and driving the low voltage sub-pixels in the second row and the third row of pixel units in a negative polarity, wherein the inverted first preset voltage is larger than the reference voltage, and the inverted second preset voltage is less than the reference voltage.

* * * * *